US007178450B1

(12) United States Patent
Baker et al.

(10) Patent No.: US 7,178,450 B1
(45) Date of Patent: Feb. 20, 2007

(54) SEALING SYSTEM FOR A COMPRESSOR

(75) Inventors: James Allen Baker, Williamsville, NY (US); Edward Wolfe, IV, Amherst, NY (US); William James Kumpf, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/244,797

(22) Filed: Oct. 6, 2005

(51) Int. Cl.
*F01B 3/00* (2006.01)
*F01B 31/10* (2006.01)

(52) U.S. Cl. ..... 92/153; 92/71

(58) Field of Classification Search ..... 92/12.2, 92/57, 58, 71, 72, 153, 154; 417/269, 273
See application file for complete search history.

(56) References Cited

U.S. PATENT DOCUMENTS

| | | | |
|---|---|---|---|
| 3,712,759 | A | 1/1973 | Olson, Jr. |
| 3,838,942 | A | 10/1974 | Pokorny |
| 3,853,434 | A | 12/1974 | Parsons |
| 3,945,765 | A | 3/1976 | Toyoda et al. |
| 4,095,921 | A | 6/1978 | Hiraga et al. |
| 4,195,970 | A | 4/1980 | Zalis |
| 4,236,878 | A | 12/1980 | Terauchi |
| 4,444,549 | A | 4/1984 | Takahashi et al. |
| 4,538,975 | A | 9/1985 | Tsukagoshi |
| 4,732,545 | A | 3/1988 | Ohta et al. |
| 4,932,845 | A | 6/1990 | Kikuchi et al. |
| 6,247,901 | B1 | 6/2001 | Unger |
| 6,523,455 | B1 | 2/2003 | Callahan et al. |
| 6,582,202 | B2 | 6/2003 | Fujii et al. |
| 6,589,022 | B2 | 7/2003 | Yokomachi et al. |
| 6,592,337 | B2 | 7/2003 | Yamada et al. |
| 6,698,232 | B1 | 3/2004 | Duppert et al. |

FOREIGN PATENT DOCUMENTS

| | | |
|---|---|---|
| EP | 0 107 409 A1 | 9/1983 |
| EP | 1 283 360 A2 | 8/2002 |

OTHER PUBLICATIONS

PCT International Publication No. WO 99/07982, Published on Feb. 18, 1999, Title: Turbocharger Integrated Bearing System, Applicant: Alliedsignal, Inc.

*Primary Examiner*—Michael Leslie
(74) *Attorney, Agent, or Firm*—Patrick M. Griffin

(57) ABSTRACT

A compressor includes a housing and a drive shaft extending along a longitudinal axis and rotatably supported by the housing. A pocket is defined in the drive shaft and extends to a bottom portion having a diameter smaller than a diameter of the pocket. A pair of sealing lip portions disposed between the housing circumscribing the drive shaft. A pair of channels is defined in the drive shaft with one of the channels exposed between the spaced lip portions to deliver a lubricant therebetween under pressure.

17 Claims, 4 Drawing Sheets

SEALING SYSTEM FOR A COMPRESSOR

BACKGROUND OF THE INVENTION

1. Field of the Invention

The subject invention relates to a sealing mechanism for a gas compressor that provides a seal about a rotary shaft to prevent fluids, such as refrigerant and lubricating oil contained in the compressor interior from leaking out to the external environment, i.e. the compressor exterior.

2. Description of the Prior Art

A typical automotive air conditioning system used in a modern automotive industry is designed to cool, dehumidify, clean, and circulate the air in a vehicle. The typical air conditioning system presents a closed, pressurized system and includes basic components such as, for example, a compressor, a condenser, a receiver/dryer or accumulator, an expansion valve or orifice tube and a plurality of additional components used in combination therewith to increase efficiency and dependability of the air conditioning system.

The compressor is the heart of the automotive air conditioning system and is designed to separate high-pressure and low-pressure sides of the air conditioning system and includes outlet and inlet portions. The primary purpose of the compressor is to draw the low-pressure and low-temperature vapor from the evaporator and compress this vapor into high-temperature, high-pressure vapor. The secondary purpose of the compressor is to circulate or pump a refrigerant through the air conditioning system under the different pressures required for proper operation of the air conditioning system. The compressor is located in an engine compartment and is driven by the engine's crankshaft via a drive belt.

The modern automotive industry includes numerous types of compressors. The types include a piston compressor, a rotary vane compressor, and a scroll-type compressor. The piston compressor includes pistons arranged in an in-line, axial, or radial designs. The pistons are engaged in cylinders, respectively, and designed to have an intake stroke and a compression stroke for each cylinder. The common variation of the piston type compressor is a variable displacement compressor, wherein the pistons are connected to a swash plate.

Conventional knowledge that is backed by test data supports the finding that refrigerant oil reduces refrigerant emissions from various components of the compressor, such as sealing lip portions of a shaft seal and O-rings, in which the refrigerant oil is present. Specifically, these components, formed from polymer, exhibit significant reduction in refrigerant permeation (or leakage) rates when these components are coated with a film of lubricant. In a pressure vessel that contains microscopic leak paths, refrigerant, backed by pressure potential, eventually displaces oil molecules in these microscopic leak paths. Consequently, the pressure vessel, wherein these leak passages are contained, develops a leak rate that is substantially higher than the leak rate when such passages are blocked, i.e. coated with the lubricant. Refrigerant leakage from the shaft seal of the compressor has long been identified as a source of leakage from refrigeration systems that can lead to increased frequency of system repair as well as contributing to atmospheric emissions of gases with a potential to contribute negatively to global climate change (greenhouse gas effect).

The art is replete with various designs of the variable displacement compressors disclosed in U.S. Pat. No. 3,945,765 to Toyoda et al.; U.S. Pat. No. 4,095,921 to Hiraga et al.; U.S. Pat. No. 4,428,718 to Skinner; U.S. Pat. No. 4,444,549 to Takahashi et al.; U.S. Pat. No. 4,960,366 to Higuchi; U.S. Pat. No. 5,056,416 to Ota et al.; U.S. Pat. No. 5,255,569 to Terauchi et al.; U.S. Pat. No. 6,416,297 to Kawaguchi et al; U.S. Pat. No. 6,564,695 to Herder et al; and U.S. Pat. No. 6,589,022 to Yokomachi et al.

The U.S. Pat. No. 6,589,022 to Yokomachi et al. teaches a compressor having a cooling structure to effectively cool a sealing device having at least first and second sealing lip portions interposed in an opening defined between a housing of the compressor and a drive shaft. A passage is exposed to a hole fluidly communicated with the opening for circulating a lubricant into the opening to lubricate exterior of only one of the sealing lip portions of the sealing device.

There is a need in the area of the compressor manufacturing industry for an improved lubrication system for lubricating a sealing device wherein the lubrication system is adaptable to maintain a reservoir of grease to ensure that components of the sealing device have adequate lubrication or grease to ensure a good sealing environment and to reduce refrigerant emission.

BRIEF SUMMARY OF INVENTION

A compressor of the present invention includes a housing having a drive shaft. The drive shaft is supported by the housing and is rotated around an axis thereby generating a centrifugal force. The drive shaft presents an annular wall defining a pocket having a bottom portion for receiving a pressurized fluid and a top portion for holding a lubricant. The drive shaft and the housing form a fluid jacket therebetween for receiving and holding the pressurized fluid therein. An actuator, such as, for example, a swash plate assembly is disposed annularly about the drive shaft and is movable relative to the housing for generating pressure in the housing. A pair of sealing lip portions is disposed between the housing and the drive shaft and circumscribing the drive shaft and for defining an annular lubricating ring between the sealing lip portions. The drive shaft defines a first channel extending through the drive shaft between the top portion of the pocket and the lubricating ring between said sealing lip portions. The drive shaft defines a second channel extending from the bottom portion of the pocket to the fluid jacket to force the pressurized fluid against the lubricant for pushing the lubricant through the first channel and between the sealing lip portions thereby constantly lubricating the partially spaced sealing lip portions.

An advantage of the present invention is to provide a drive shaft design having a pocket filled with a lubricant, such as, for example, grease, exposed through a first channel defined in the drive shaft at a higher pressure in response to the compressor crank case pressure extending from a bottom of the pocket portion that forces the grease through the first channel between two sealing lip portions of the sealing device.

Another advantage of the present invention is to provide a lubrication system for the compressor to adequately lubricate or grease the components of the sealing device to reduce wear of the sealing device and to provide a good sealing environment and to reduce refrigerant emissions.

Still another advantage of the present invention is to provide a lubrication system applicable to any "open-type", i.e. non-hermetic compressor, wherein a drive shaft extends through the compressor to the external environment to provide a means of applying an external source of rotational power to the drive shaft and, hence, to the compressing mechanism.

Still another advantage of the present invention is to provide a lubrication system applicable to any type of compressors and is independent of the operative mechanism utilized to create gas compression, e.g., reciprocating, scroll, rotary, screw mechanisms.

Still another advantage of the present invention is to provide a lubrication system, the applicability of which extends beyond the scope of automotive air conditioning compressor to provide an effective seal for any rotating drive shaft.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
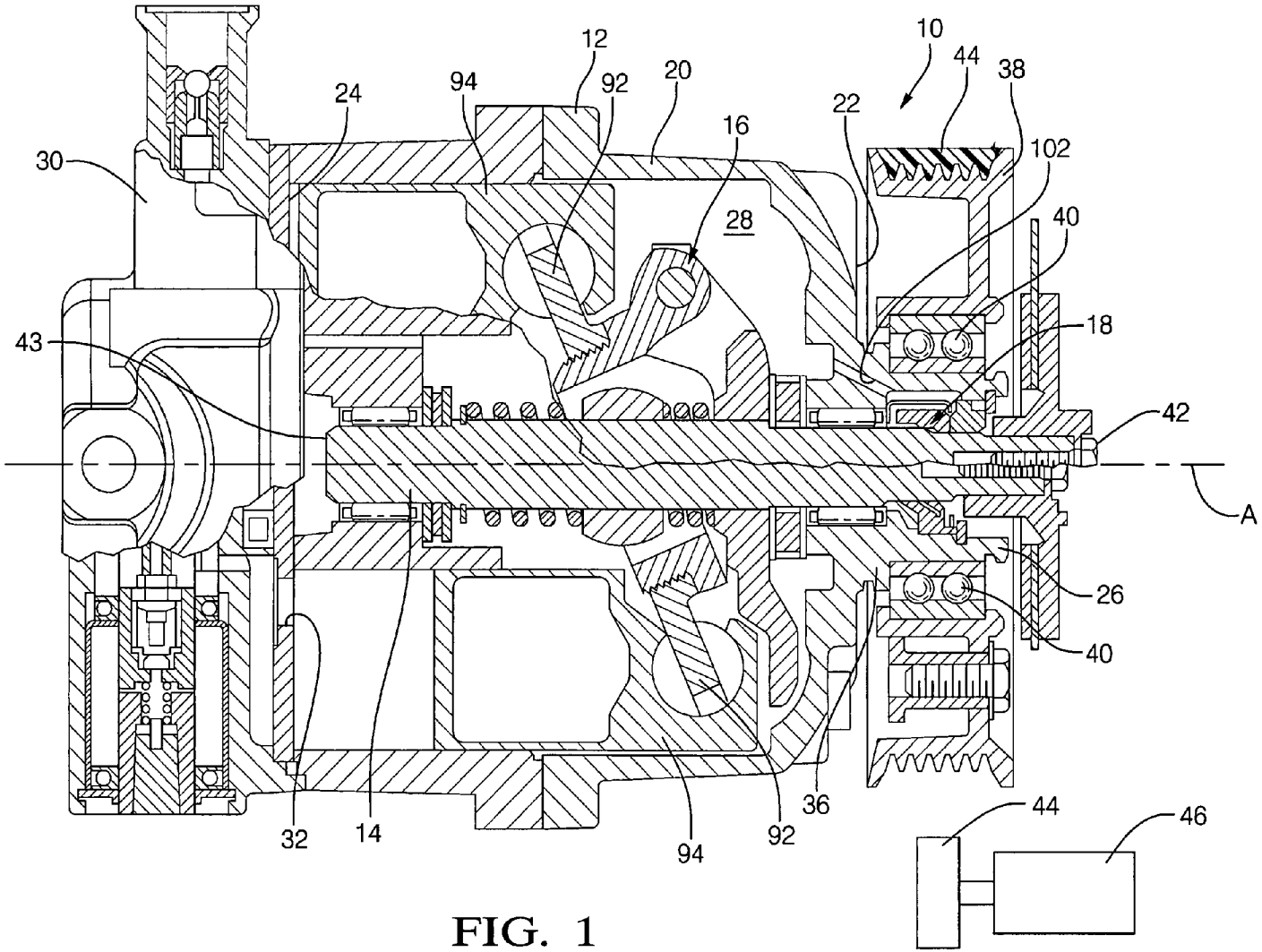
FIG. 1 is a cross sectional view of a compressor having a drive shaft disposed therein.
Figure 2:
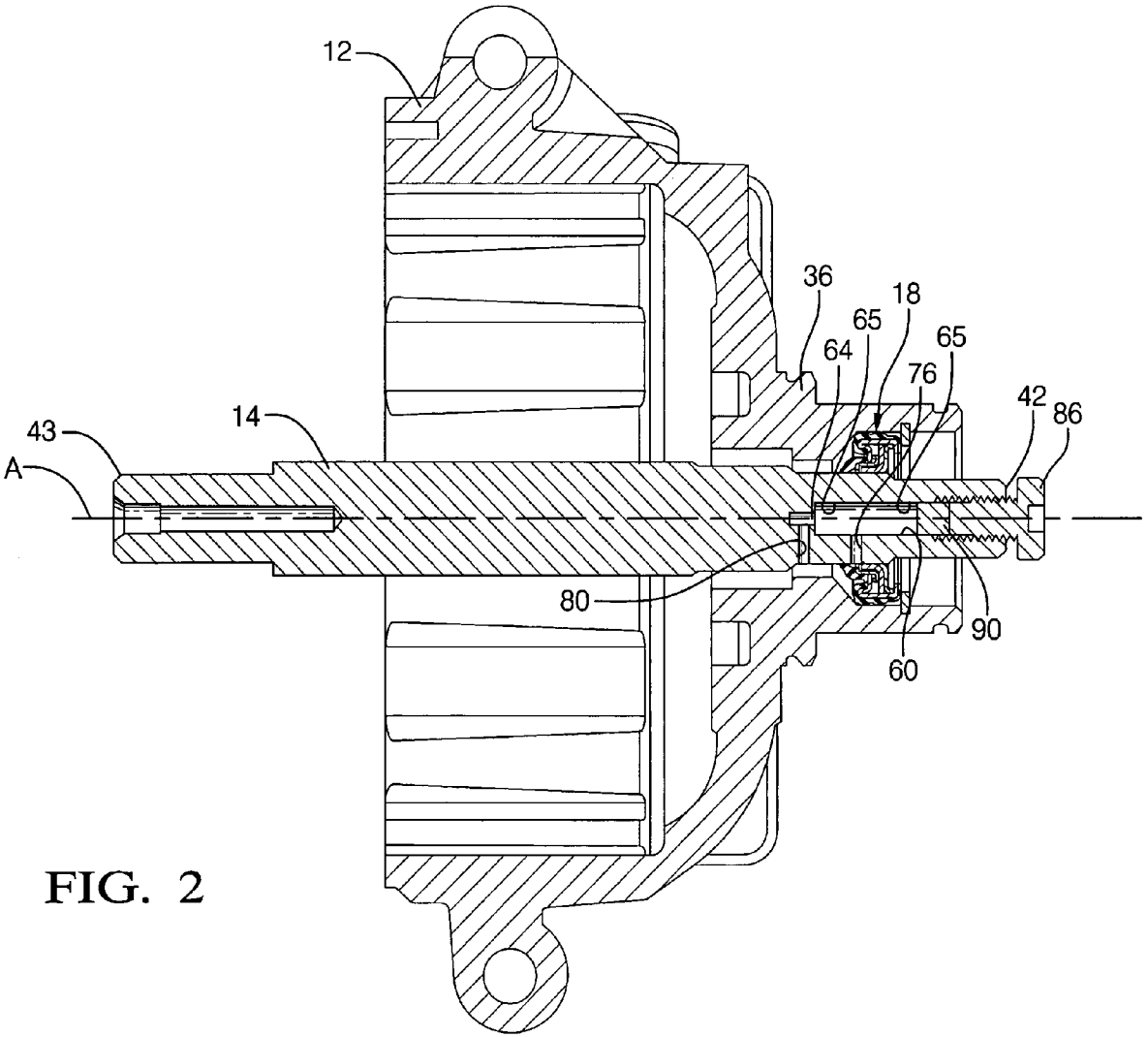
FIG. 2 is a cross sectional and partial view of the drive shaft extending through a housing of the compressor.

Referring now to FIGS. 1 and 2, wherein like numerals indicate like or corresponding parts throughout the several views, a compressor is generally shown at 10. The compressor 10 includes a housing 12 and a drive shaft 14 extending along a longitudinal axis A, an actuator, such as, for example, a swash plate assembly, generally indicated at 16, operatively connected to and driven by the drive shaft 14. A sealing device, generally indicated at 18, is disposed between the housing 12 and the drive shaft 14 circumscribing the drive shaft 14. The compressor 10, the sealing device 18 and the drive shaft 14 will be discussed in great details as the description of the present invention proceeds.

The housing 12 of the compressor 10 includes a central portion 20 having terminal ends 22, 24, and a rear portion 26 connected to the central portion 20 at the terminal end 22. The compressor 10 includes a crank chamber 28 defined within the central portion 20. The compressor 10 further includes a front portion 30 connected to the central portion 20 at the other terminal end 24. The front portion 30 includes a suction chamber and a discharge chamber (both not shown). The compressor includes a suction port 32 and a discharge port (not shown) defined in the front portion 30. A boss 36 projects from the rear portion 26 and surrounds the drive shaft 14. A pulley 38 is rotatably supported by annular bearings 40 on the peripheral surface of the boss 36. The pulley 38 is connected to one terminal end 42 of the drive shaft 14 projecting from the rear portion 26 of the housing 12. A belt 44 is engaged with the peripheral portion of the pulley 38 and directly connects the pulley 38 with a vehicle engine 46, serving as an external drive force, without using an electromagnetic clutch or the like. Alternatively, as appreciated by those skilled in the art, during the operational mode of the compressor 10, the drive shaft 14 may also be connected to an electromagnetic clutch assembly (not shown) driven by the vehicle engine 46.

Figure 3:
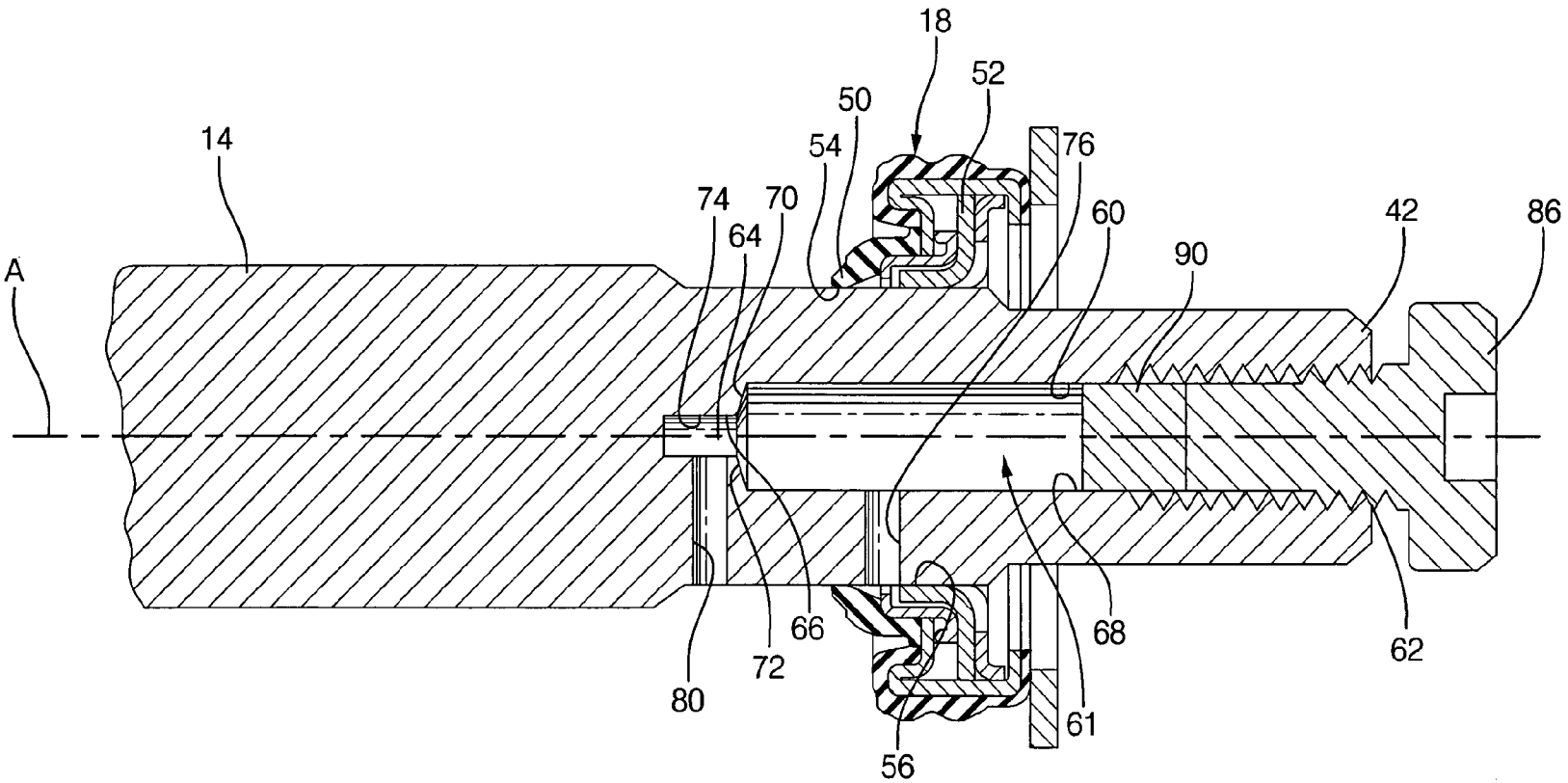
FIG. 3 is a cross sectional view of the drive shaft having a pocket defined therein.
Figure 4:
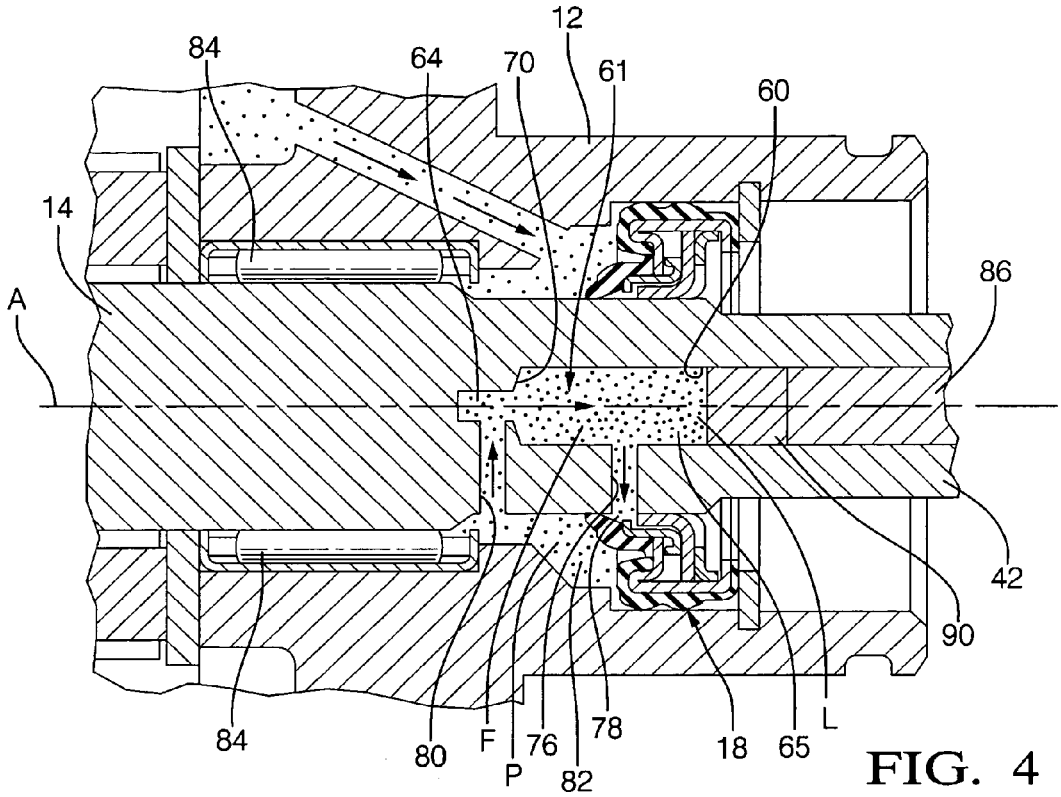
FIG. 4 is a fragmental and cross sectional view of the drive shaft and the pocket defined therein with a pair of channels defined in the drive shaft illustrating lubrication process of a sealing device disposed between the housing and the drive shaft.

As best shown in FIG. 3, the sealing device 18 includes several components mechanically engaged one with the other. One of these components is a rubber sealing lip portion or first lip ring 50 and a second lip portion or second lip ring 52, which is arranged toward the outer side of the compressor 10 with respect to the first lip ring 50. The first lip ring 50 and the second lip ring 52, respectively, have contact portions 54, 56 that contact the outer surface of the drive shaft 14 to prevent leakage of a pressurized fluid F, such as, for example, a refrigerant that may contain oil mixed with the refrigerant, when the drive shaft 14 is rotated or stopped. The lip rings 50 and 52 are formed from polymeric and non-polymeric materials. For example, one of the first lip ring 50 and the second lip ring 52 is formed from an elastomer whereas another of the rings is formed from polytetrafluoroethylene, also known as PTFE. Those skilled in the art will appreciate that other sealing devices may be used with the present invention and the particular embodiment of the sealing device 18 is not intended to limit the present invention.

Referring to FIGS. 1 through 4, the drive shaft 14 of the present invention includes a generally cylindrical configuration. The drive shaft 14 has a variable diameter, as viewed in cross section. The drive shaft 14 includes an inner annular wall 60 defining a pocket, generally indicated at 61, at the terminal end 42. The pocket 61 functions as a reservoir for holding additional grease sealant, i.e. a lubricant L in a top portion 65 of the pocket 61. The pocket 61 is exposed to an open top 62 co-planar with the terminal end 42 and extends from a bottom portion 64 opposite from the open top 62 to the top portion 65. The bottom portion 64 has a diameter 66 smaller than a diameter 68 of the pocket 61. For example, the bottom portion 64 may present a transitional surface 70. The transitional surface, for example, may be defined by conical ramp diametrically transitioned from the axis A to the pocket 61.

A first channel 76 is defined in the drive shaft 14 and is exposed from the pocket 61 and between the partially spaced first lip ring 50 and the second lip ring 52 defining a lubrication bath 78, i.e. a lubricating ring therebetween. The first channel 76 connects the pocket 61 to the lubrication bath 78. A second channel 80 is defined in the drive shaft 14 and extends from the cavity 74 at the axis A and exposed to a fluid jacket 82. The second channel 80 functions as an equalization passage connecting the internal compressor volume to the pocket 61. The fluid jacket is defined between a pair of needle bearings 84, disposed between the drive shaft 14 and the housing 12 for facilitating rotational movement of the drive shaft 14 relative to the housing 12, and the sealing device 18. The second channel 80 receives the pressurized fluid P from the fluid jacket 82 to force the pressurized fluid P against the lubricant L contained in the pocket 61 thereby forcing the lubricant L through the first channel 76 at a higher pressurized rate in response to rotation of the drive shaft 14 thereby constantly lubricating the partially spaced first lip ring 50 and the second lip ring 52.

Figure 5:
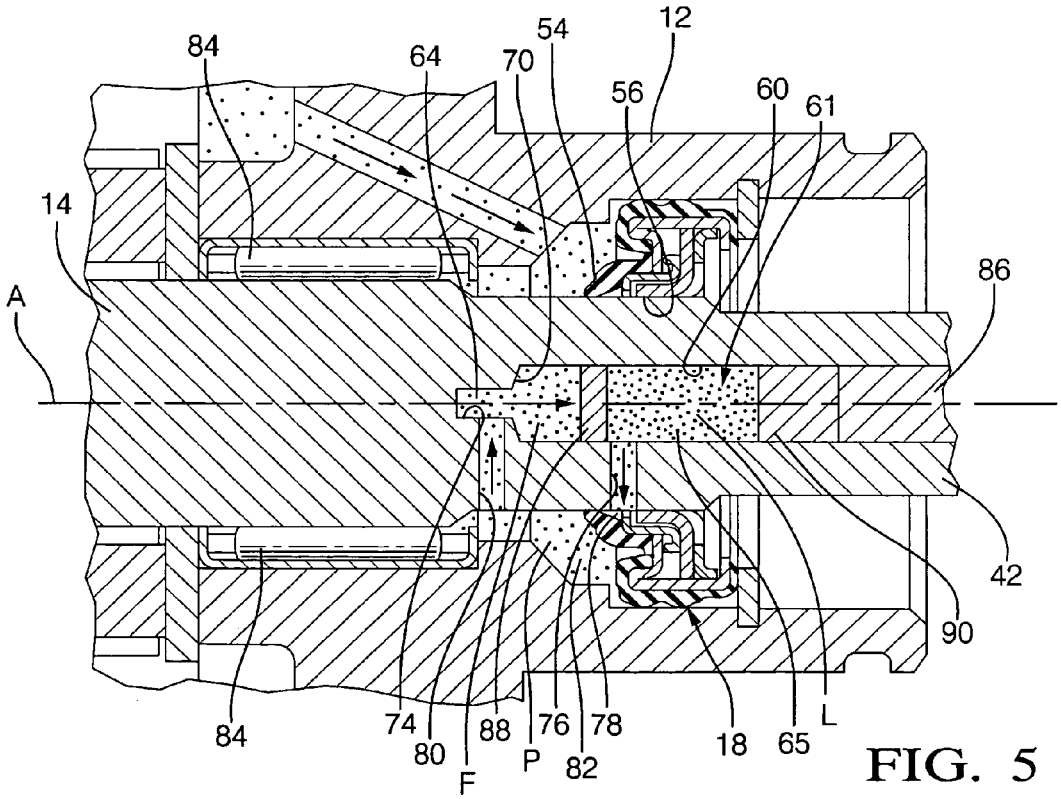
FIG. 5 is another fragmental and cross sectional view of an alternative embodiment of the drive shaft illustrating a plunger disposed in the pocket to assist the lubrication process of the sealing device of FIG. 4.

A fastener 86 is disposed through the open top 62 at the terminal end 42. The fastener 86 partially extends into the pocket 61 to close the open top 62. In one of the alternative embodiments of the present invention, as shown in FIG. 5, a plunger 88 is disposed in the pocket 61 between the first channel 76 and the second channel 80 for separating various fluids circulating through the first channel 76 and the second channel 80, whether the fluids are immiscible or not, and to improve pressure applied to the lubricant, such as, for example, grease, escaping from the first channel 76. A sealing member, such as, for example, a sealing piston 90 is disposed in the pocket 61 abutting the fastener 86.

The swash plate assembly 16 includes a swash plate 92 movable forwardly and rearwardly along the axis A in a sinusoidal motion, being inclined with respect to the axis A to diverge from a perpendicular position to an angular position with respect to the axis A in different modes of operation of the compressor 10. The swash plate assembly 16 includes a plurality of pistons 94 coupled to the swash plate 92 for reciprocating in the central portion 20 upon movement of the swash plate 92. The swash plate assembly 16 is known to those skilled in the art and is not described herewith in great details.

The pressurized fluid F is under refrigerant pressure in the interior of the compressor 10. The pressurized fluid F then enters to the pocket 61 through the second channel 80 thereby forcing the lubricant L contained in the pocket 61 between the pressurized fluid F and the fastener 86. The lubricant L contained between the first lip ring 50 and the second lip ring 52 acts as a barrier to the pressurized fluid F movement from the high pressure interior of the compressor through the sealing device 18 to the atmosphere. The lubricant L contained in the pocket 61 replenishes any grease that migrates past either of the first lip ring 50 or the second lip ring 52. The movement of the lubricant L from the pocket 61 to the lubrication bath 78 is driven by centrifugal force created by rotation of the drive shaft 14. The second channel 80 functioning as the equalization passage allows the pressure in the pocket 61 to equilibrate to the internal compressor pressure allowing the centrifugal force to exert a small delta pressure for replenishment of the lubricant L.

The practical application of the present invention extends beyond the scope of automotive air conditioning compressors and provides an effective seal for any rotating drive shaft in other compressor mechanisms. The present invention is applicable to any "open-type", i.e. non-hermetic compressor mechanisms, such as, for example, reciprocating, scroll, rotary, screw type compressor mechanisms, wherein a drive shaft extends through a compressor to the external environment to provide a means of applying an external source of rotational power to the drive shaft and, hence, to the compressor mechanism.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A compressor comprising;

a housing, a drive shaft supported by said housing and rotatable around an axis thereby generating a centrifugal force, said shaft presenting an annular wall defining a pocket and a bottom portion for receiving a pressurized fluid and a top portion for holding a lubricant, said drive shaft and said housing forming a fluid jacket therebetween for holding the pressurized fluid therein, an actuator disposed annularly about said drive shaft and movable relative to said housing for generating pressure inside said housing, a pair of sealing lip portions disposed between said housing and said drive shaft and circumscribing said drive shaft for defining an annular lubricating and sealing ring between said sealing lip portions, said drive shaft defining a first channel extending through said drive shaft between said top portion of said pocket and said lubricating ring between said sealing lip portions, and said drive shaft defining a second channel extending from said bottom portion of said pocket to said fluid jacket to force the pressurized fluid against the lubricant for pushing the lubricant through said first channel and between said sealing lip portions thereby constantly lubricating and sealing said partially spaced sealing lip portions.

2. A compressor as set forth in claim 1 wherein said annular wall presents a diameter larger than a diameter of said bottom portion.

3. A compressor as set forth in claim 2 wherein said first channel extends from said annular wall and through said drive shaft for establishing fluid communication between said pocket and said partially spaced sealing lip portions.

4. A compressor as set forth in claim 3 wherein said first channel is shorter in length than said second channel.

5. A compressor as set forth in claim 4 wherein said bottom portion presents a transitional surface interconnected by and exposed to a cavity with said transitional surface being diametrically transitioned from said axis to said annular wall of said pocket.

6. A compressor as set forth in claim 5 wherein said drive shaft presents terminal ends with said pocket defined at one of said terminal ends and is exposed to an open top.

7. A compressor as set forth in claim 6 including a sealing member disposed through said open top at said terminal end into said pocket.

8. A compressor as set forth in claim 7 including a fastener disposed through said open top at said terminal end and partially extends into said pocket to close said open top.

9. A compressor as set forth in claim 8 including a plunger disposed in said pocket between said first channel and said second channel for separating the pressurized fluid from the lubricant with said plunger forcing the lubricant through said first channel at a higher pressure in response to the pressurized fluid applied to said plunger and combined with the centrifugal force generated by said drive shaft rotating around said axis (A) thereby constantly lubricating and sealing said partially spaced sealing lip portions.

10. A compressor comprising;

a housing, a drive shaft supported by said housing and rotatable around an axis generating a centrifugal force, said shaft presenting an annular wall defining a pocket and a bottom portion for receiving a pressurized fluid and a top portion for holding a lubricant, said drive shaft and said housing forming a fluid jacket therebetween for holding the pressurized fluid therein, an actuator disposed annularly about said drive shaft and movable relative to said housing for generating pressure inside said housing, a pair of sealing lip portions disposed between said housing and said drive shaft and circumscribing said drive shaft for defining an annular lubricating and sealing ring between said sealing lip portions, said drive shaft defining a first channel extending through said drive shaft between said sealing lip portions and a second channel extending from said bottom portion of said pocket to said fluid jacket, and a plunger disposed in said pocket between said first channel and said second channel for separating the pressurized fluid from the lubricant with said plunger forcing the lubricant through said first channel at a higher pressure in response to the pressurized fluid applied to said plunger as combined with the centrifugal force generated by said drive shaft thereby constantly lubricating and sealing said partially spaced sealing lip portions.

11. A compressor as set forth in claim 10 wherein said first channel extends between said top portion of said pocket and said lubricating ring between said sealing lip portions.

12. A compressor as set forth in claim 11 wherein said annular wall presents a diameter larger than a diameter of said bottom portion.

13. A compressor as set forth in claim 12 wherein said first channel is shorter in length than said second channel and positioned above said first channel as viewed in cross section.

14. A compressor as set forth in claim 13 wherein said bottom portion presents a transitional surface interconnected by and exposed to a cavity with said transitional surface being diametrically transitioned from said axis to said annular wall of said pocket.

15. A compressor as set forth in claim 14 wherein said drive shaft presents terminal ends with said pocket defined at one of said terminal ends and is exposed to an open top.

16. A compressor as set forth in claim 15 including a sealing member disposed through said open top at said terminal end into said pocket.

17. A compressor as set forth in claim 16 including a fastener disposed through said open top at said terminal end and partially extends into said pocket to close said open top.

* * * * *